US005194897A

United States Patent [19]

Yoshiyama et al.

[11] Patent Number: 5,194,897

[45] Date of Patent: Mar. 16, 1993

[54] IMAGE FORMING APPARATUS WITH CHARGE WIRE CLEANERS

[75] Inventors: Tsugihito Yoshiyama, Toyohashi; Tadafumi Shimizu, Kurume; Hiroyuki Ideyama; Yoshihiko Hatta, both of Toyokawa; Masazumi Ito, Toyohashi, all of Japan

[73] Assignee: Minolta Camera Kabushiki Kaisha, Osaka, Japan

[21] Appl. No.: 795,982

[22] Filed: Nov. 22, 1991

[30] Foreign Application Priority Data

Nov. 27, 1990 [JP] Japan ..... 2-326984

[51] Int. Cl.[5] ..... G03G 21/00; G03G 15/00

[52] U.S. Cl. ..... 355/215; 355/221

[58] Field of Search ..... 355/215, 219, 221, 245, 355/246; 250/324

[56] References Cited

U.S. PATENT DOCUMENTS 4,811,050 3/1989 Tanjo et al. ..... 355/221

5,012,093 4/1991 Shimizu ..... 250/324

FOREIGN PATENT DOCUMENTS 2-179659 7/1990 Japan ..... 355/221

*Primary Examiner*—Joan H. Pendegrass

[57] ABSTRACT

An image forming apparatus for forming hardcopy images by electrophotographic process using a developing device for toner developing and chargers for charging and discharging by corona discharge, the image forming apparatus having cleaners for removing toner adhering to a charge wire of each charger, each cleaner is operated when a predetermined amount of toner has been supplied to the developing device. In another example, each cleaner is operated when a toner accommodating bottle becomes empty and is detached from the image forming apparatus.

12 Claims, 7 Drawing Sheets

IMAGE FORMING APPARATUS WITH CHARGE WIRE CLEANERS

BACKGROUND OF THE INVENTION

1. Field of the Invention

The present invention relates to an image forming apparatus for forming hardcopy images using an electrophotographic process.

2. Description of the Related Art

Electrophotographic processes are widely used in conventional copying machines, facsimiles, page printers and the like as hardcopy image forming means.

Electrophotographic processes comprise a charging process for uniformly charging the surface of a photosensitive member, exposure process for forming an electrostatic latent image on the surface of the photosensitive member in accordance with image data via said exposure process, developing process for forming a toner image by adhering toner to the aforesaid electrostatic latent image, transfer process for transferring said toner image onto a copy sheet, and fixing process for fusing said transferred toner image on the copy sheet.

Image forming apparatus which use electrophotographic processes also use corona chargers provided with a discharge wire. These corona chargers are used as sensitizing chargers, transfer chargers, and separation chargers for separating the copy sheet from the photosensitive member.

Corona chargers are provided discharge wires to which is typically applied a high voltage ranging from about one thousand and several hundred to several thousand volts to accomplish corona discharge. The aforesaid corona discharge supplied a uniform electrical charge to the photosensitive member and the copy sheet.

When the corona discharger is used over a long period of time, toner waste dispersed within the image forming apparatus adheres to the discharge wire, thereby changing the discharge characteristics which in turn reduces the charging efficiency relative to the photosensitive member and copy sheet, and thus produces uneven charged state thereon.

When, for example, a corona charger is used as a sensitizing charger, the change in charging characteristics relative to the photosensitive member causes variations in image density, so that the uneven charging produces irregularities and spotting of the image. Image disturbance due to inadequate transfer or paper jams due to inadequate separation also result when corona chargers are used as transfer chargers or separation chargers.

In order to prevent the aforesaid adverse influences, image forming apparatus are conventionally provided a cleaning means to automatically eliminate the debris adhering to the corona wire.

The period during which the corona wire is cleaned by the cleaning means is generally when power is switched on to the image forming apparatus, or when the corona charger is used and a predetermined number of image formation sheets have been processed.

When the power is switched on to the image forming apparatus, and the warmup period may be used for cleaning the corona wire. However, cleaning of the corona wire will not be accomplished during the period after the power is switched on to the image forming apparatus, and if the apparatus is operated continuously over a long period may result in progressive soiling of the corona wire. Therefore, when the image forming apparatus is to be used continuously over a long period, the power must be switched off temporarily and restarted thereafter. This arrangement is disadvantageous inasmuch as it necessitates a troublesome additional operation for the operator.

When the cleaning period is set by means of the operation time and number of sheets used in image formation, further disadvantages arise inasmuch as the intervals at which cleaning is executed does not necessarily coincide with the intervals at which cleaning is required. That is, the degree to which toner adheres to the corona wire is not necessarily proportional to the operation time and number of sheets used in image formation and will vary in accordance with the B/W ratio (black-to-white ratio) of the original document for image density settings and copies. Accordingly, in practice the discharge wire is not cleaned in spite of adhering toner to the discharge wire thereby reducing the charging characteristics and the wasteful downtime of image forming apparatus is caused during which said apparatus cannot be used (non-operating time for cleaning) when said discharge wire is cleaned while still unsoiled.

As a means of eliminating the aforesaid disadvantages the provision of a suitable sensor has been considered to detect the operating state (operating current and the like) of the corona charger, or the charge state of the photosensitive member and copy sheet. A determination can be made as to the necessity of cleaning the discharge wire based on the aforesaid detection values.

In this arrangement, however, an image forming apparatus having a plurality of corona charger must provide a sensor for each corona charger therein. This arrangement, therefore, has other disadvantages inasmuch as the cost of the image forming apparatus is increased and the control of said image forming apparatus is rendered more complex.

SUMMARY OF THE INVENTION

A main object of the present invention is to provide an image forming apparatus limits the cost increase and complexity of control.

A further object of the present invention is to provide an image forming apparatus capable of producing image of stable and uniform quality.

A still further object of the present invention is to provide an image forming apparatus capable of cleaning charging means at suitable intervals.

These and other objects of the present invention are accomplished by providing an image forming apparatus for forming hardcopy images by electrophotographic process using developing means for toner developing and charging means for charging and discharging by corona discharge, comprising cleaning means for removing toner adhering to said charging means, means for measuring an amount of toner supplied to said developing means, and means for operating said cleaning means when the amount of toner measured by said measuring means has reached a predetermined amount.

These and other objects of the present invention are further accomplished by providing an image forming apparatus for forming hardcopy images by electrophotographic process using developing means for toner developing and charging means for charging and discharging by corona discharge, comprising cleaning means for removing toner adhering to said charging means, toner accommodating means for supplying toner to said developing means therefrom, and means for operating said cleaning means when said toner accommodating means becomes empty of toner.

These and other objects, advantages and features, of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1:
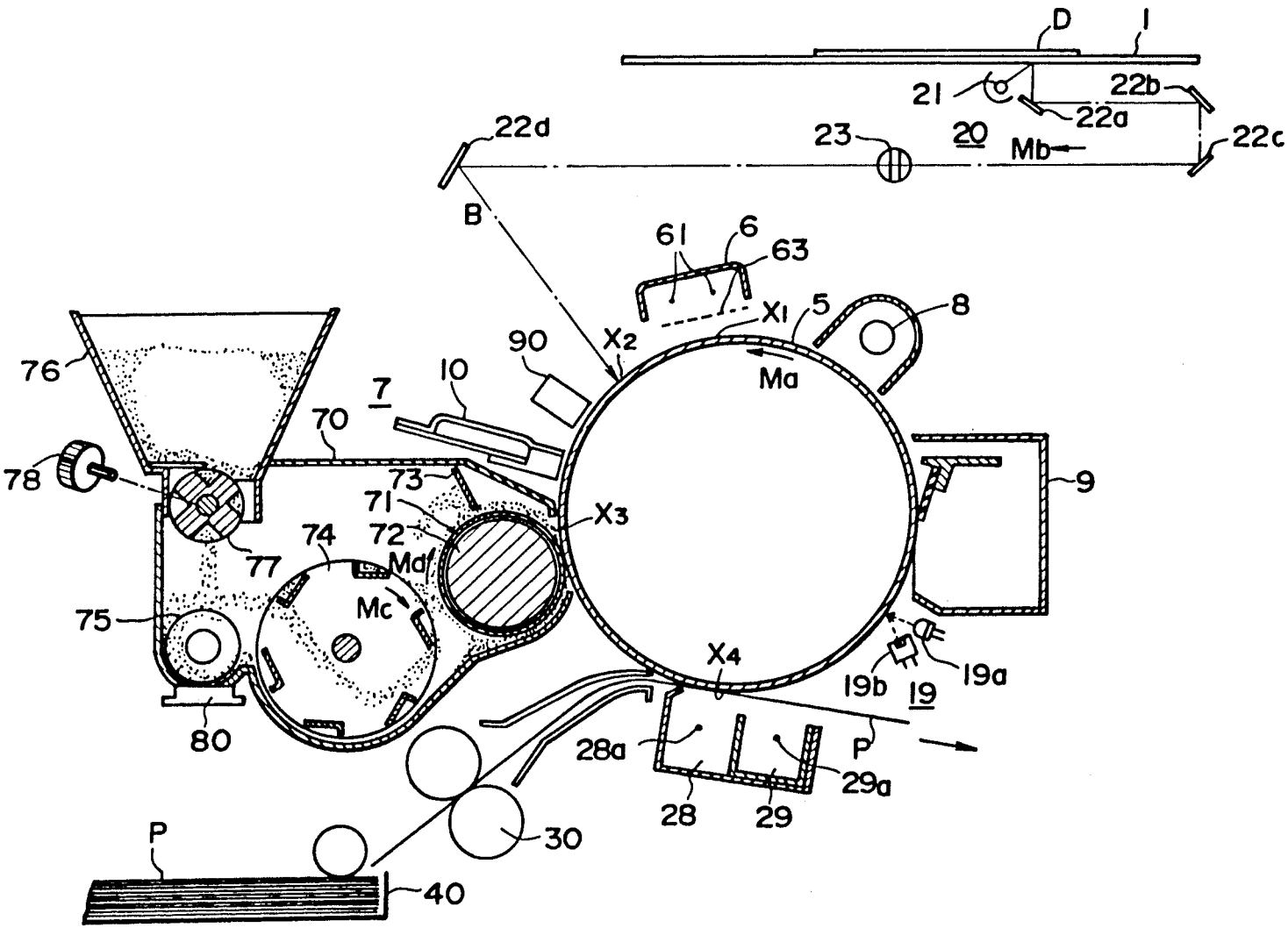
FIG. 1 is an elevation view in section showing the essential portion of an embodiment of the copying machine of the present invention.

FIG. 1 is an elevation view in section showing the essential portion of the copying machine A.

In the drawing, the photosensitive drum 5 is disposed so as to be rotatable in the direction indicated by the arrow Ma at constant circumferential speed. Provided around the periphery of the photosensitive drum 5 for the purpose of accomplishing the electrophotographic process is a charger 6, image interval eraser 10, developing unit 7, transfer charger 28, separation charger 29, cleaning device 9, and main eraser 8. The exposure position X2 and the image interval eraser 10 have disposed therebetween a surface electrometer 90 for measuring the surface potential of the photosensitive drum 5. Between the separation charger 29 and the cleaning device 9 have disposed a reflective type photosensor (AIDC sensor) 19 comprising a photoemitter **19*a* and a photoreceptor 19*b*** for measuring standard toner image density.

The charger 6 is a scorotron type charger having a charge wire 61 and mesh-like grid 63 stretched within a box type shield. The charge wire 61 has a high voltage current applied thereto by a high voltage transformer 600 controlled by the central processing unit (CPU) 201 described later. The electrical charge applied to the surface of the photosensitive drum 5 from the charge wire 61 is controlled by controlling the potential of the grid 63, thereby determining the surface potential of the photosensitive drum 5. The charger 6 is provided a wire cleaner 100 (described later) for removing the toner that adheres to the charge wire 61.

The surface of the photosensitive drum 5 is uniformly charged as said surface of the drum passes the charging position X1 opposite the aforesaid charger 6, and is exposed to the light from the optical unit 20 at the exposure position X2. The electrical charge on the surface of the photosensitive drum 5 is partially eliminated by the aforesaid exposure so as to form an electrostatic latent image on the surface of the photosensitive drum 5 which corresponds to the image of the original document D, whereas the electrical charge on the other portion of the surface of the photosensitive drum 5 exclusive of the latent image portion is removed therefrom by the image interval eraser 10.

The optical unit 20 comprises an exposure lamp 21 for exposing the original document D disposed on the glass document platen 1, mirrors **22*a* through 22*d* for guiding the reflected light B from the document D to the exposure position X2, and a projection lens 23. During the exposure scanning time for the original document D, the exposure lamp 21 and the mirror 22*a* move in the direction of arrow Mb at a speed v/m (where "m" is the copy magnification), and the mirrors 22*b* and 22*c*** are movable at a speed v/2 m.

The electrostatic latent image formed on the surface of the photosensitive drum 5 is then developed as a toner image by the developing unit 7.

The developing unit 7 uses developer material comprising a mixture of magnetic carrier and an insulative toner, and develops a positive image by adhering toner to the electrostatic latent image (the electrical charge-bearing portion, i.e., the unexposed portion) as said latent image passes the developing position X3 via a well known magnetic brush method. The interior of the developing tank 70 is provided with a developing sleeve 71 installed within a magnetic roller 72, brush-height regulating member 73, bucket roller 74, and screw roller 75. Furthermore, a toner density sensor (ATDC sensor) 80 is provided below the aforesaid screw roller 75.

When the bucket roller 74 rotates in the direction of the arrow Mc, the developer is attracted by the magnetic force of the magnetic roller 72 on the exterior surface of the developing sleeve 71, and is transported to the developing position X3 in accordance with the rotation of the said developing sleeve 71 in the direction of the arrow Md. The ATDC sensor 80 measures the toner percentage by weight T/C (wt %) relative to all the developing material via the magnetic permeability of said developer.

At the top portion of the developing tank 70 is provided a toner hopper 76 for temporarily holding the toner supplied from the toner supply device 60 described later. At the bottom portion of the developing tank 70 is provided a toner replenishment roller 77. When making copies, the toner is replenished so as to maintain the toner percentage by weight T/C (wt %) at a standard value based on the output of the ATDC sensor 80. That is, the toner replenishment roller 77 is rotatably driven via the resupply motor 78 at suitable times so as to supply toner from the toner hopper 76 to the screw roller 75 in accordance with the quantity of toner consumed by developing. At this time, the quantity of replenished toner is proportional to the number of rotations (rotational drive time) of the resupply motor 78.

The replenished toner is mixed with the developer present within the developing tank via the rotation of the screw roller 75 and transported to the bucket roller 74. The toner is triboelectrically charged via the aforesaid mixing process, such that the magnetic carrier and the toner are charged with dissimilar electrical polarities. The negative polarity toner adheres to the surface of the photosensitive drum 5 at the developing position X3 via the electrostatic attraction between the toner and the charged surface of the photosensitive drum 5. At this time, a developing bias VB of a predetermined voltage is applied to the developing sleeve 71 to prevent toner adhesion by the residual charge (electrical charge remaining on the exposed portion of the drum surface) remaining on the surface of the photosensitive drum 5.

On the other hand, the copy sheet P is fed from the removably installed cassette 40 and transported by the timing roller 30 with a timing that coincides with the rotation of the photosensitive drum 5, and the toner image on the drum 5 is transferred to the sheet P at the transfer position X4 via the discharge of the transfer charger 28. The transfer charger 28 is a corotron type charger having a charge wire 28*a* to which is applied a direct current (DC) high voltage of 5 to 7 kV.

The sheet P bearing the transferred toner image is separated from the photosensitive drum 5 via a discharge received from the separation charger 29, and the sheet is then transported to a fixing unit not shown in the drawing. The separation charger 29 is also a corotron type charger provided with a charge wire 29*a* to which is applied an alternating current (AC) high voltage of 4 to 6 kVrms.

The transfer charger 28 and the separation charger 29 are both provided with wire cleaners 100 having identical constructions.

Thereafter, the residual toner remaining on the surface of the photosensitive drum 5 is removed therefrom by a cleaning device 9, and the residual charge remaining on said surface is removed therefrom by the main eraser 8. The photosensitive drum 5 is thus prepared for the subsequent exposure.

Figure 2:
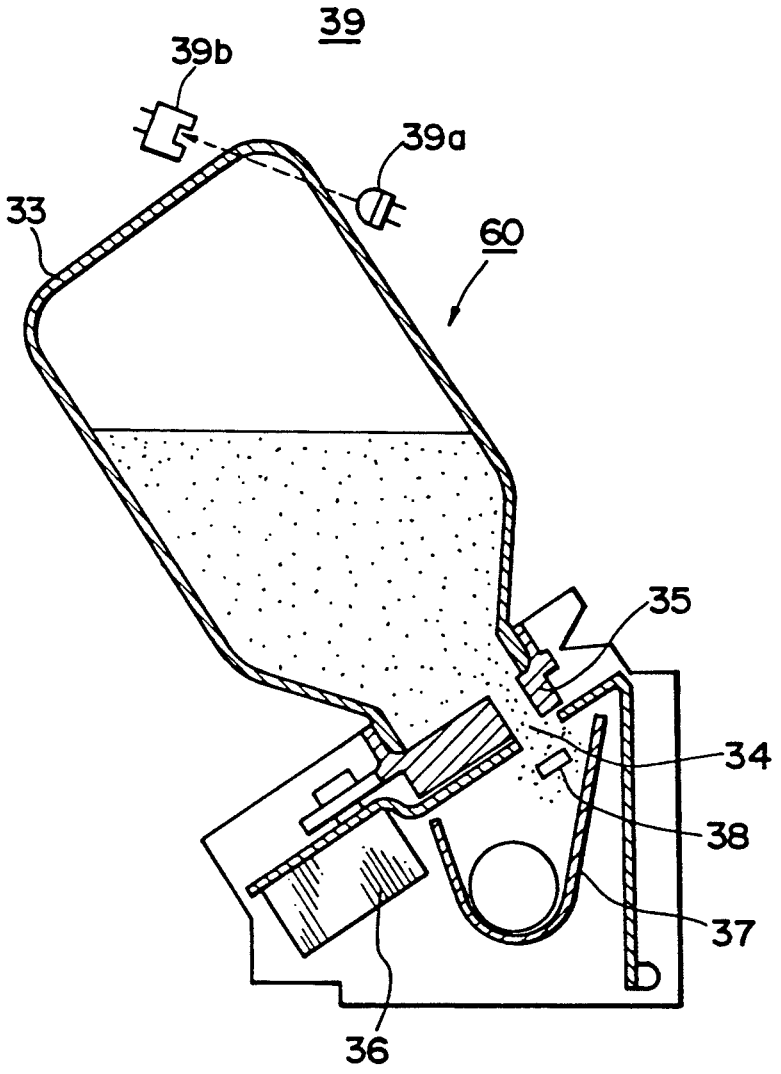
FIG. 2 is an elevation view in section showing the toner supplying device in the aforesaid embodiment.

FIG. 2 is an elevation view in section showing the toner supply device 60.

The toner supply device 60 comprises a toner bottle 33 for accommodating toner, feed gear 35, guide panel 37 and the like. The toner bottle 33 is removably installed in the feed gear 35 with its opening facing downward. The toner accommodated in the toner bottle 33 is transported to the previously mentioned toner hopper 76 through square hole 34 of the feed gear 35 and the guide panel 37 via the rotation of the motor 36. The presence or absence of toner in the toner bottle 33 is detected by a reflection type photosensor 38 provided below the square hole 34. The installation and removal of the toner bottle 33 is detected by the photosensor 39 comprising photoemitter 39*a* and photoreceptor 39*b*; said photosensor 39 is switched ON when the toner bottle 33 is removed.

Figure 3:
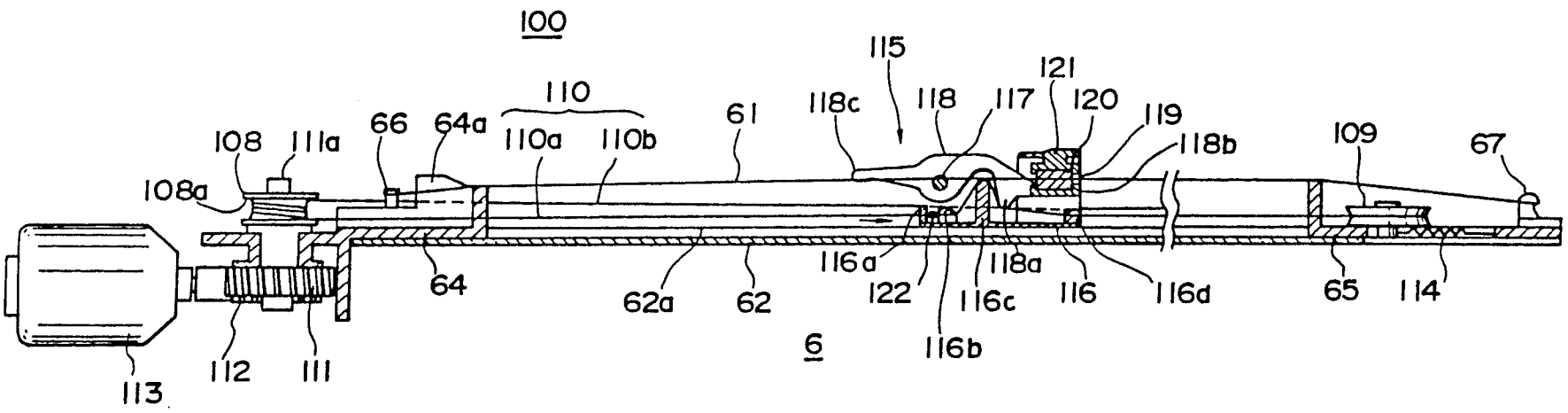
FIG. 3 is an elevation view of the wire cleaner provided to the charger of the present embodiment.

FIG. 3 is an elevation view showing the wire cleaner 100 provided in the charger 6.

The charger 6 comprises a shielded case 62 formed of metal plate, unit holders 64 and 65 mounted on both ends of the shielded case 62, and corona discharge charge wire 61 stretched between the unit holders 64 and 65. On the other hand, the fixed pin 66 is an electrode pin to which is applied the voltage required for corona discharge via a high voltage transformer not shown in the drawing. Furthermore, the unit holder 64 is provided a land member 64*a* upon which rides the flush member 118*c* of the support member 118.

On the other hand, the wire cleaner 100 comprises drive pulley 108 rotatably mounted on the unit holder 64, driven pulley 109 mounted so as to have its axis rotatable from left to right in FIG. 3 relative to unit holder 65, drive rope 110 reeved between the drive pulley 108 and driven pulley 109, gear 111 integratedly provided on the same axis as shaft 111*a* of drive pulley 108 so as to rotate as a unit therewith, DC motor 113 capable of forward and reverse rotation for rotatably driving worm gear 112 which engages the aforesaid gear 111, tension spring 114 tensed against the driven pulley 109 so as to exert a force in the direction of the driven roller 110, and travelling member 115 which is movable from left to right in FIG. 3 along rail 62*a* attached to the shielded case 62.

The drive pulley 108 is formed of rubber material having a high friction coefficient such as expanded urethane and the like. The central portion of the drive pulley 108 has a U-shaped channel 108*a* of minimum diameter in which is wound the aforementioned drive rope 110.

The travelling member 115 comprises a base member 116, support member 118 rotatably mounted on a support shaft 117 provided on said base member 116, first cleaning member 119 mounted on the member 118*b* that receives the front end of the support member 118 and makes pressure contact with the charge wire 61 via the rotation of the support member 118, and second cleaning member 120 mounted on support rod 121 of the base member 116 at a position opposite the first cleaning member 119.

Regulating members 116*a* through 116*d* are provided on the base member 116. The drive rope 110*a* on one side of the drive rope 110 passes below the regulating members 116*a*, 116*b* and 116*d* and passes above the regulating member 116*c*.

A regulating member 122 is fixedly attached to the drive rope 110 between the regulating members 116*a* and 116*b*, said regulating member 122 linking the drive rope 110 and the base member 116 in the direction of travel. Furthermore, the linkage 118*a* provided on the support member 118 between the regulating members 116*c* and 116*d* contacts the drive rope 110*a* from the top, such that the linkage 118*a* provided on the support member 118 cleaning member 119 is thereby pressed into contact with the charge wire 61 and the second cleaning member 120 from below.

Furthermore, the support member 118 is provided a flush member 118*c* which rotates the support member 118 to the right at the home position (left end position in FIG. 3) of the traveling member 115. This arrangement eliminates pressure contact of the first cleaning member 119 on the charge wire 61.

When the flush member 118*c* rides up onto the land member 64*a*, the support member 118 rotates on the support member 117 rightwardly in the drawing against the force exerted by the drive rope 110, such that the first cleaning member 119 separates from the charge wire 61 and second cleaning member 120. The charge wire 61 is thus released from contact with the first and second cleaning members 119 and 120 and resides in a free state which returns to the original tension position.

The components within the previously described construction which are affected by the corona discharge of the aforesaid charge wire, i.e., drive rope 110 and traveling member 115 and the like, are formed of insulative materials such as synthetic resin, synthetic rubbers and the like. Whereas other components may be formed of suitable synthetic resins and metallic material and the like.

The charger 6 discharges when the traveling member 115 is at the home position. Cleaning is automatically accomplished by the traveling member with a timing described below.

During the cleaning process, the traveling member 115 departs the home position of the initial state and starts to move rightwardly via the forward rotation of the motor 113, and the flush member 118*c* separates from the land member 64*a*. The support member 118 rotates leftwardly and the linkage 118*a* is pushed upward by the force of the drive rope 110, and the first cleaning member 119 moves upward to make pressure contact with the charge wire 61 and second cleaning member 120. That is, the charge wire 61 is gripped between the first and second cleaning members 119 and 120, and the traveling member 115 moves along the charge wire 61.

When the traveling member 115 reaches the right end, the base member 116 abuts the unit holder 65 and is stopped thereby. The increase in the load current of the motor 113 produced by the aforesaid stopping of the traveling member 115 is detected and the motor 113 is reversely rotated to return the traveling member 115 to the home position.

The wire cleaner 100 having the previously described construction is also provided in the aforementioned transfer charger 28, separation charger 29 and the like. The mechanisms for cleaning each charger are not limited to the previously described device of the present embodiment.

Figure 4:
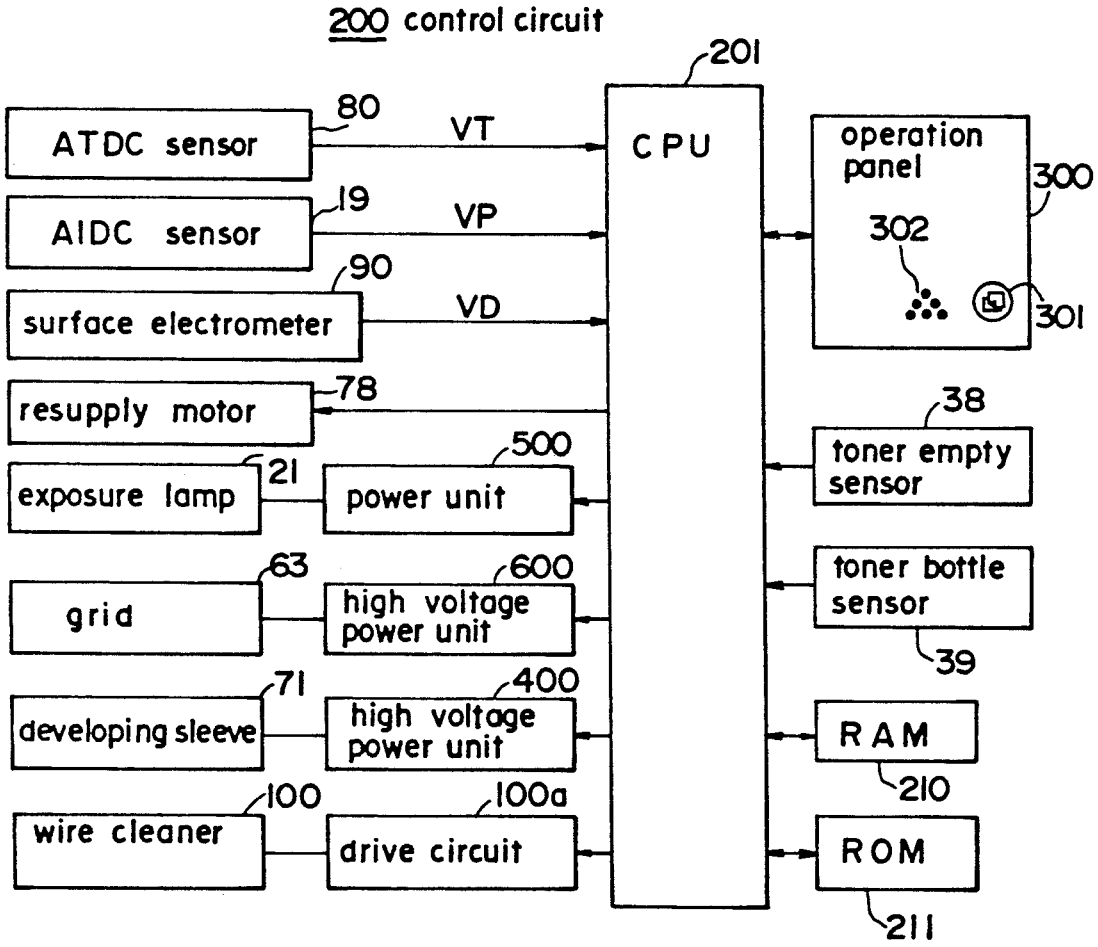
FIG. 4 is a block diagram showing the control circuit of the present embodiment of the copying machine.

FIG. 4 is a block diagram of the control circuit 200 of the copying machine A.

The control circuit 200 has at its core a central processing unit (CPU) 201 for controlling all operations of the copying machine A.

The CPU 201 receives the output signals of the various sensors such as the aforementioned ATDC sensor 80, AIDC sensor 19, surface electrometer 90, as well as toner empty sensor 38, toner bottle sensor 39 for detecting the presence of the toner bottle and the like. The CPU 201 further transmits control signals to the exposure lamp power unit 50 0 for lighting the exposure lamp 21, high voltage power unit 600 for supplying voltage to the grid 63, high voltage power unit 400 for supplying the developing bias VB, drive circuit 100*a* for the wire cleaner 100 and the like. The CPU 201 is also connected to the control panel 300, random access memory (RAM) 210 which stores the control data for various controls, read only memory (ROM) 211 for storing programs and the like.

The operation panel 300 provides a print key 301 for starting the printing operation, various operation keys such as a density set key for setting image density (not shown in the drawing), various display means such as toner empty display light 302 which lights when the toner bottle 33 is empty and the like.

Dispersion of toner from the developing unit 7 and the surface of the photosensitive drum 5 cannot be prevented in the copying machine A of the previously described construction using an electrophotographic process. Therefore, as the operation time of the apparatus is increases, the discharging characteristics of the charger 6, transfer charger 28 and separation charger 29 are reduced by the dispsersed toner which adheres to the charge wires 61, 28*a* and 29*a*.

The quantity of toner adhering to the charge wires 61, 28*a* and 29*a* increases, particularly when many high density copy images are made. That is, when the operator sets the copy conditions as desired to increase the copy image density from the standard density, the toner percentage by weight (wt %) in the developing unit 7 is increased beyond the standard value and stabilized, whereupon toner is then supplied to the developing unit 7.

As previously described, the newly replenished toner is inadequately mixed with the carrier and is readily dispersed as airborne powder due to the minimal triboelectric charge imparted thereto. Thus, a large quantity of toner is naturally consumed when dense copy images are formed, so that the charge wires 61, 28*a* and 29*a* are readily soiled.

When copying original documents D having a high B/W ratio, large quantities of toner are consumed compared the quantities of toner consumed when copying other documents D, even when forming copy images of standard density. Therefore, the charge wires 61, 28*a* and 29*a* are readily soiled in the same way as when high density copy images are formed. At this time the toner is replenished to the developing unit 7 in accordance with toner consumption.

Accordingly, even when a predetermined number of copy images are formed in a predetermined time period, as more toner is consumed during said time period the increased degree of soiling of the charge wires 61, 28*a* and 29*a* can be inferred.

In copying machine A, the necessity for cleaning the charge wires 61, 28*a* and 29*a* can be determined based on the amount of toner replenishment.

Figure 5:
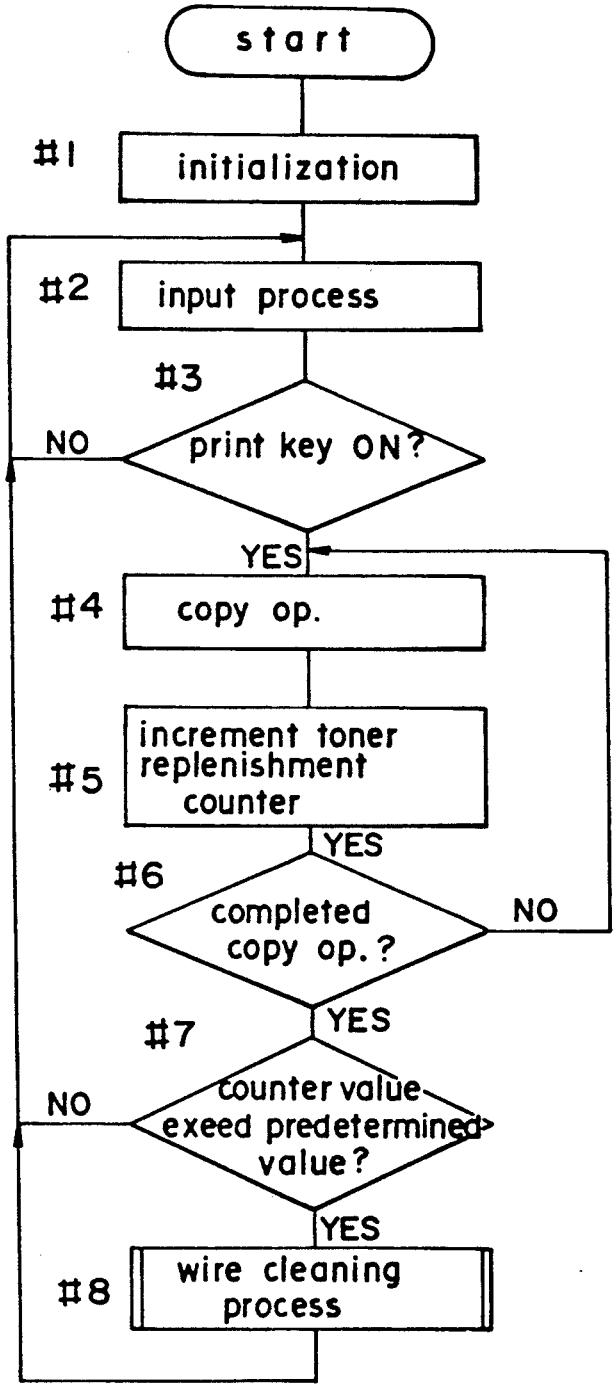
FIG. 5 is a main flow chart showing an example of the brief operation of the copying machine of the present embodiment.

FIG. 5 is a flow chart showing a brief example of the operation of the copying machine A.

When the power is switched ON, the CPU 201 starts the program, and all portions of the copying machine A are initialized (step #1). Then, the input process is executed for receiving signals from the various sensors and operation keys of the operation panel 300 (step #2).

Then, the ON/OFF status of the print key 301 is checked, (step #3). When the print key 301 has been depressed, the copy operation controls are executed (step #4) in accordance with the copy conditions set on the operation panel 300, i.e. said copy conditions being copy number, magnification, image density and the like.

Thereafter, the toner replenishment counter, which calculates the amount of toner supplied to the developing unit 7, is incremented by a value corresponding to the quantity of toner replenished (step #5). At this time, the amount of toner replenished is indicated by the total number of revolutions (rotational drive time) of the supply motor 78 which drives the toner replenishment roller 77.

Subsequently, a check is made to determine whether or not the set number of copies have been completed. If the copy operation is still on-going, the program returns to step #4 (step #6).

When the copy operation has been completed, a check is made to determine whether or not the toner replenishment counter value has exceeded a predetermined value (step #7). If the toner replenishment counter value exceeds said predetermined value, the charge wires 61, 28*a* ad 29*a* are inferred to be rather soiled, as previously described, so that the wire cleaning process is executed for cleaning the charge wires 61, 28*a* and 29*a* by the wire cleaner 100 (step #8).

Figure 6:
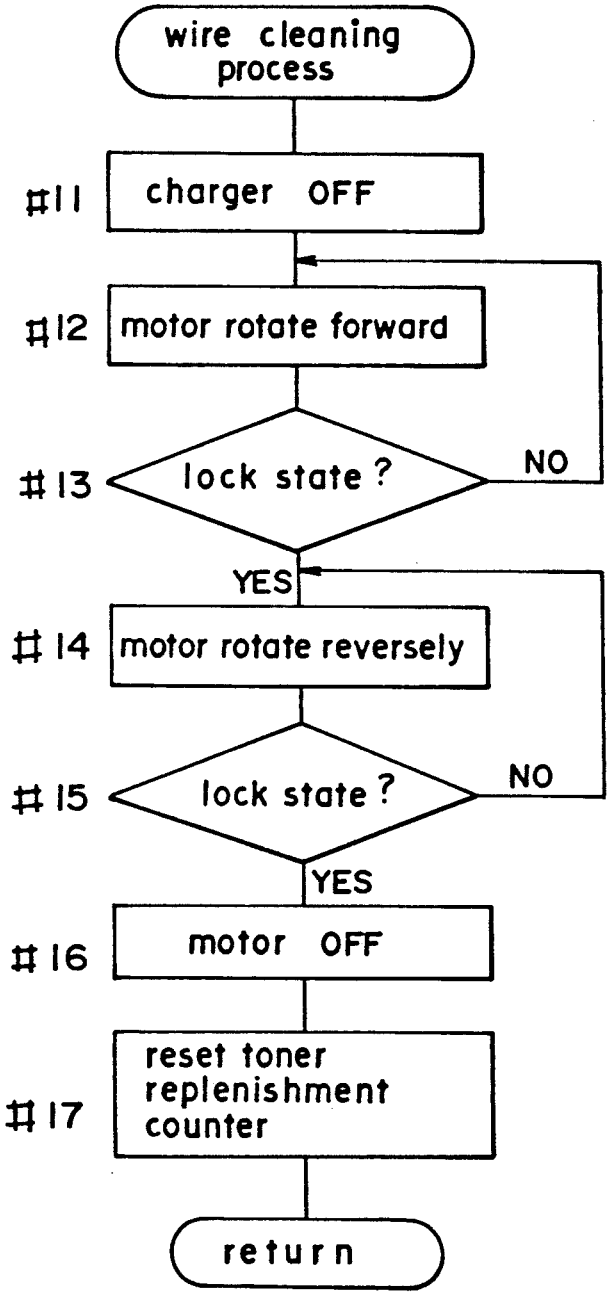
FIG. 6 is a flow chart showing the wire cleaning process showed in FIG. 5.

FIG. 6 is a flow chart showing the wire cleaning process.

The process for cleaning the charge wire of the charger 6 is described below.

First, the voltages being supplied to the charger 61 and grid 63 are stopped, and the charger 6 is switched OFF (step #11).

Next, the motor 113 described in FIG. 3 is forward rotated, so that the traveling member 115 moves from the home position toward the unit holder 65 (step #12).

The traveling member 115 moves until it abuts the unit holder 65 whereupon said traveling member 115 stops, thereby increasing the load on the motor 113 (lock state)(step #13). Then, the motor 113 is reversely rotated to return the traveling member 115 (step #14).

The traveling member 115 returns to the home position and again enters the lock state (step #15). Then, the motor 113 is switched OFF (step #16).

While the traveling member 115 is performing the aforesaid reciprocative movement, the charge wire 61 is gripped between the first and second cleaning members 119 and 120, as previously described, thereby removing the toner adhering from said charge wire 61.

Subsequently, the toner replenishment counter is reset and the process is completed (step #17).

Figure 7:
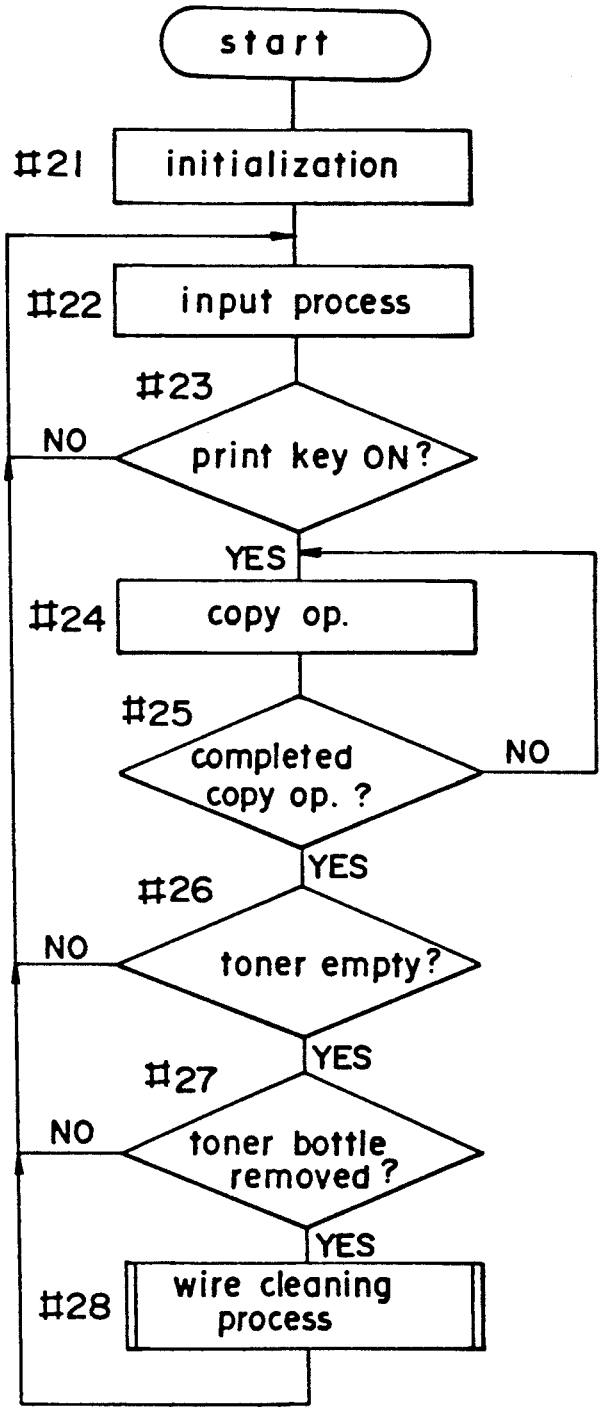
FIG. 7 is a main flow chart showing another example of the operation of the copying machine of the present invention.

FIG. 7 is a main flow chart showing another example of the operation of the copying machine A.

In steps #21 through #24 initialization, input process, print key 101 ON status check, and copy process are sequentially executed in the same manner as previously described for steps #1 through #4.

Thereafter, a copy completion check is made (step #25). After copy completion, a check is made to determine the presence of toner in the toner bottle 33 via the output of the toner empty sensor 38 (step #26).

When no toner is present in the toner bottle 33, toner is replenished in an amount commensurate with the capacity of the toner bottle 33. It is therefore determined that the charge wire cleaning process is required at this time.

Since the copying operation is stopped during the on-going execution of the wire cleaning process, the operator therefore cannot start the next copy operation. This arrangement is likely to reduce the effective use of the copying machine A.

Therefore, after the CPU 201 has detected the toner empty condition, the removal of the empty toner bottle 33 from the copying machine A and its replacement by a new toner bottle is awaited (step #27), and the wire cleaning process is executed (step #28). That is, the charge wire cleaning process is executed during the period wherein the empty toner bottle 33 is replaced. Copies can still be made even in the toner empty condition by using the toner accommodated in the toner hopper 76.

The processes in steps #7 through #8, and steps #26 through #28 executed by the CPU 201 in the present embodiment correspond to the function of the cleaning control means of the present invention.

According to the embodiment described above, the necessity or lack of the charge wire cleaning process is determined based on the amount of toner replenishment which is mutually related to the degree of soiling of the charge wires 61, 28*a* and 29*a*. Therefore, timely wiring cleaning execution is achieved and the deterioration of discharge characteristics as well as the downtime associated with unnecessary cleaning of the charge wire are prevented compared to the execution of the wire cleaning process at standard intervals based on operation time and the number of copies made.

According to the previously described embodiment, the wire cleaning process is executed during the waiting period after copy completion and prior to the start of the next copy operation. Therefore, downtime due to charge wire cleaning can be minimized.

Furthermore, according to the present embodiment, the charge wire cleaning process is also executed so as to utilize the downtime during which the copy operation is stopped for the removal of the toner bottle 33 for replacement thereof. Therefore, although a slight delay may be produced by the execution of the charge wire cleaning process, said downtime is minimal compared to that resulting from the execution of the wire cleaning process alone and further reduction in the efficient use of the copying machine A is prevented.

Still further, according to the present embodiment, the reference value for determining the need for charge wire cleaning based on the amount of toner replenishment can be suitably selectable in accordance with statistical data relating to the use conditions of the copying machine. The cleaning of the charge wires of the charger 6, transfer charger 28 and separation charger 29 need not be accomplished simultaneously, and may be accomplished with different timing. The present invention further may be applied to dischargers.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus for forming images comprising:

developing means for developing latent images;

charging means for charging and discharging by corona discharge;

cleaning means for removing toner adhering to said charging means; and control means for controlling to operate said cleaning means in accordance with the consumption of toner.

2. An image forming apparatus for forming images comprising:

charging means for charging and discharging by corona discharge;

cleaning means in contact with said charging means for cleaning the same to remove foreign material including a developer adhering thereto;

supplying means to supply the developer to a developing means; and means to activate said cleaning means for cleaning said charging means in accordance with the condition of said supplying means.

3. An image forming apparatus for forming hardcopy images by electrophotographic process using developing means for toner developing and charging means for charging and discharging by corona discharge, comprising:

cleaning means for removing toner adhering to said charging means;

measuring means for measuring an amount of toner supplied to said developing means; and means for operating said cleaning means when the amount of toner measured by said measuring means has reached a predetermined amount.

4. The image forming apparatus as claimed in claim 3, wherein said developing means including a toner supplying roller driven by a supplying motor and said measuring means including a counter for counting the number of rotation of said supplying motor so as to measure the amount of toner by counting the number of rotation thereof.

5. The image forming apparatus as claimed in claim 3, wherein said cleaning means includes a cleaning unit having a first and a second cleaning members which are provided across a charging wire of said charging means and capable of pressing contacting each other, said cleaning means cleaning said charging means by reciprocating movement of said cleaning unit with said first and second cleaning members pressing contact each other.

6. An image forming apparatus for forming hardcopy images by electrophotographic process using developing means for toner developing and charging means for charging and discharging by corona discharge, comprising:

cleaning means for removing toner adhering to said charging means;

toner accommodating means for supplying toner to said developing means therefrom; and control means for controlling to operate said cleaning means when said toner accommodating means becomes empty of toner.

7. The image forming apparatus as claimed in claim 6, wherein said cleaning means removes toner while said toner accommodating means is removed from said image forming apparatus.

8. The image forming apparatus as claimed in claim 7, wherein whether said toner accommodating means is removed is determined by a photosensor including a photoemitter and a photoreceptor.

9. The image forming apparatus as claimed in claim 6, wherein said cleaning means includes a cleaning unit having a first and a second cleaning member which are provided across a charging wire of said charging means and capable of pressing contacting each other, said cleaning means cleaning said charging means by reciprocating movement of said cleaning unit with said first and second cleaning members pressing contact each other.

10. An image forming apparatus for forming hardcopy images by electrophotographic process using developing means for toner developing and charging means for charging and discharging by corona discharge, comprising:

cleaning means for removing toner adhering to said charging means;

driving means for electrically driving said cleaning means;

toner accommodating means for supplying toner to said developing means therefrom;

detecting means for detecting a replenishment state of said toner accommodating means; and control means for controlling to operate said driving means to drive said cleaning means in response to the detection of the replenishment state by said detecting means.

11. An image forming apparatus for forming hardcopy images by electrophotographic process using developing means for toner developing and charging means for charging and discharging by corona discharge, comprising:

cleaning means for removing toner adhering to said charging means;

driving means for electrically driving said cleaning means;

toner accommodating means for supplying toner to said developing means therefrom;

detecting means for detecting whether or not said toner accommodating means is detached from the image forming apparatus; and control means for controlling to operate said driving means to drive said cleaning means when said detecting means detects the detachment of said toner accommodating means from the image forming apparatus.

12. An image forming apparatus for forming hardcopy images by electrophotographic process using consumable materials and charging means for charging and discharging by corona discharge, comprising:

cleaning means for removing toner adhering to said charging means;

driving means for electrically driving said cleaning means;

signal generating means for generating a signal when the consumable materials are replenished; and control means for controlling to operate said driving means to drive said cleaning means in response to the signal generated by said signal generating means.

* * * * *

UNITED STATES PATENT AND TRADEMARK OFFICE

CERTIFICATE OF CORRECTION

PATENT NO. : 5,194,897

DATED : March 16, 1993

INVENTOR(S) : Tsugihito Yoshiyama, et al.

It is certified that error appears in the above-identified patent and that said Letters Patent is hereby corrected as shown below:

In col. 6, lines 41 and 42, before "cleaning member 119", delete "provided on the support member 118" and insert --is pushed upward and the first--.

Signed and Sealed this

Thirtieth Day of November, 1993

Bruce Lehman

BRUCE LEHMAN

*Commissioner of Patents and Trademarks*

*Attest:*

*Attesting Officer*